US006550454B2

(12) United States Patent
Boecking

(10) Patent No.: US 6,550,454 B2
(45) Date of Patent: Apr. 22, 2003

(54) INJECTOR WITH SUBDIVIDED PRESSURE MULTIPLIER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/007,200

(22) Filed: Nov. 8, 2001

(65) Prior Publication Data

US 2002/0084348 A1 Jul. 4, 2002

(30) Foreign Application Priority Data

Nov. 8, 2000 (DE) ..... 100 55 270

(51) Int. Cl.[7] ..... F02M 37/04
(52) U.S. Cl. ..... 123/446; 123/495; 417/401
(58) Field of Search ..... 123/446, 495, 123/500, 501, 198 D; 92/255, 140; 417/401

(56) References Cited

U.S. PATENT DOCUMENTS 4,098,560 A * 7/1978 O'Neill ..... 417/214
5,152,678 A * 10/1992 Zeck ..... 417/401
5,655,885 A * 8/1997 Chung ..... 417/44.2
5,950,601 A * 9/1999 Nemoto et al. ..... 123/495
6,293,252 B1 * 9/2001 Niethammer et al. ..... 123/447
6,360,721 B1 * 3/2002 Schuricht et al. ..... 123/446

FOREIGN PATENT DOCUMENTS

DE 198 35 494 A1 2/2000

* cited by examiner

*Primary Examiner*—Carl S. Miller
(74) *Attorney, Agent, or Firm*—Michael J. Striker

(57) ABSTRACT

An injector for injection a fuel under high pressure into a combustion chamber of an internal combustion engine, the injector has an injector housing, a control chamber, a primary-side inlet to the control chamber, a control valve which controls the primary-side inlet to the control chamber, a pressure multiplier movable in the injector housing, the pressure multiplier being formed as a two-part piston arrangement.

7 Claims, 1 Drawing Sheet

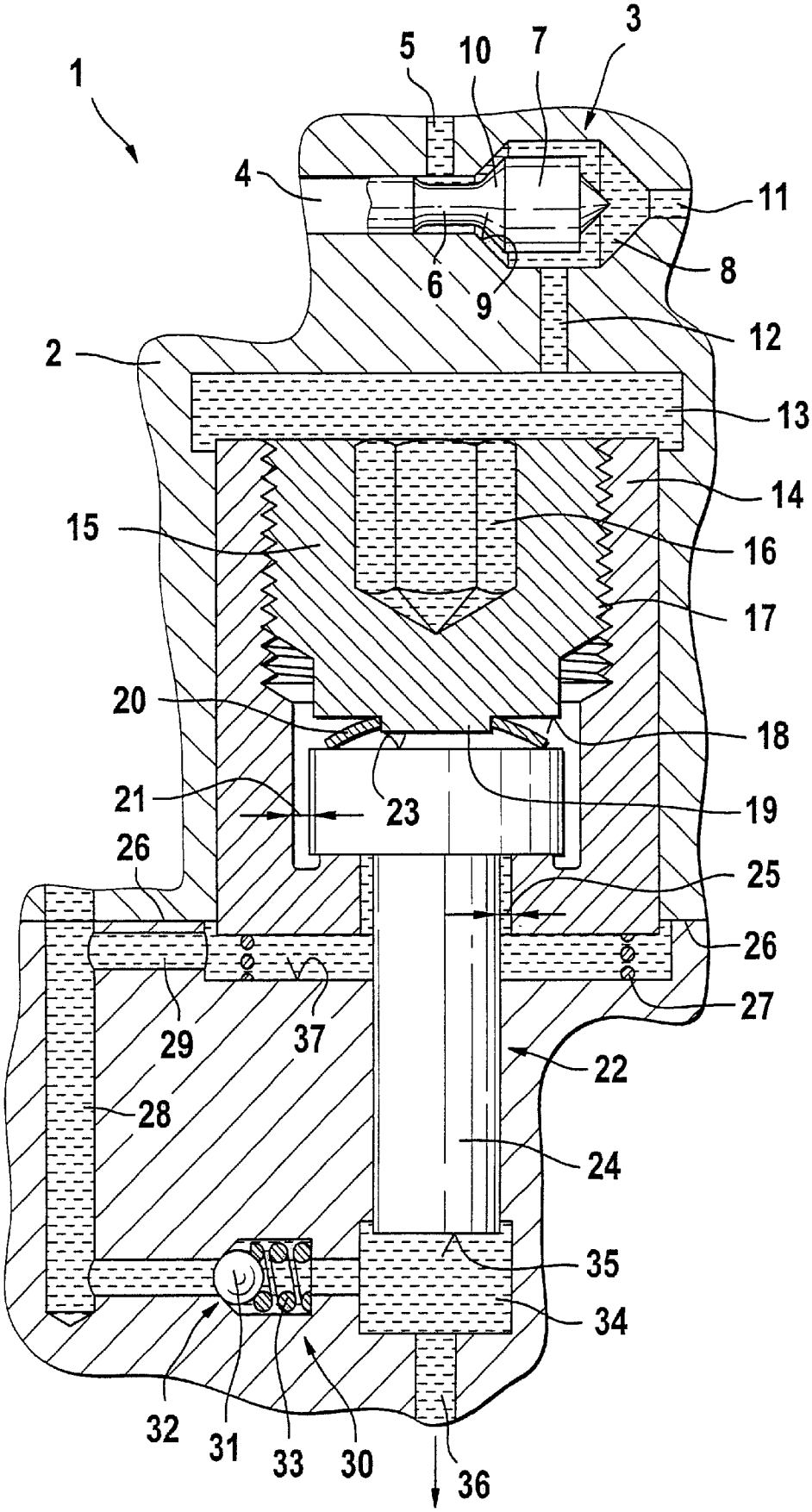
1
2
3
4
5
6
7
8
9
10
11
12
13
14
15
16
17
18
19
20
21
22
23
24
25
26
26
27
28
29
30
31
32
33
34
35
36
37

INJECTOR WITH SUBDIVIDED PRESSURE MULTIPLIER

BACKGROUND OF THE INVENTION

The present invention relates to injectors with subdivided pressure convertors or multipliers.

Injectors are utilized in fuel injection system for injection of fuel under high pressure into combustion chambers of internal combustion engines with direct injection. The injection start and the injection quantity are adjusted with the injectors. The injectors are located at the position of the previously utilized nozzle holder combinations. The injectors can be used without significant modifications of cylinder heads of the internal combustion engines. The injectors can have pressure multipliers, with which a primary pressure at the inlet side can be significantly increased.

German patent document DE 198 35 494 A1 discloses a pump-nozzle unit. It supplies the combustion chamber of an internal combustion engine with fuel under high pressure. A pump unit serves for building up an injection pressure, so that the fuel can be injected via an injection nozzle into combustion chamber of an internal combustion engine. Furthermore, a control valve connected with a control unit is provided, which can be formed as an outwardly open A-valve. A valve actuating unit controls the pressure buildup in the pump unit. For providing a pump-nozzle unit with a control unit which has a simple construction, is small and has in particular a short response time, it is proposed to form a valve actuating unit as a piezo-electric actuator. In this pump-nozzle unit, a valve actuating unit is associated with a single-part hydraulic multiplier. It serves in a corresponding design for transmission of a small expansion movement of the actuator into a great valve actuating movement.

SUMMARY OF THE INVENTION

Accordingly, it is an object of the present invention to provide an injector with a subdivided pressure convertor or multiplier which is a further improvement of the existing injectors.

In keeping with these objects and with others which will become apparent hereinafter, one feature of present invention resides, briefly stated, in an injector with a subdivided pressure multiplier in which the pressure multiplier is formed as a two-part piston arrangement.

With the inventive two-part design of the pressure multiplier, a simple construction can be provided, so that a cost-favorable production is guaranteed. When the pressure multiplier which is composed of two piston elements, is formed so that a radial play is provided with respect to the opening of the injector housing which receives the piston, then an expensive manufacture of a one-part piston which requires high manufacturing tolerances can be avoided. The subdivision of the piston element into two individual pistons allows, due to a subdivision of the housing which receives the pistons, a cost favorable manufacture both of the individual pistons which operates as a pressure multiplier, as well as two-part housing.

The both pistons, of which one piston forms limiting surface of a control chamber in which a control pressure acts, while the other piston extends with an end side into a pressure chamber, are spread or in other words pre-tensioned for making difficult the separation at the contact surfaces by a spring element. It is therefore guaranteed that the pistons do not separate during an axially extending stroke movement.

The individual pistons of the piston arrangement are pretensioned relative to one another in an axial direction, to avoid separation of the pistons during the stroke on their contact surfaces. For compensation of mounting tolerances, to the contrary the individual pistons are received with a play relative to one another. In other words the outer individual piston is guided in the upper housing half, while the inner piston is guided in its lower housing half with a plate. Thereby the housing tolerances and manufacturing tolerances of the components are compensated, so that the manufacture of the pressure multiplier together with the housing can be achieved in a substantially most cost-favorable manner.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawing is a view illustrating an injector with a subdivided pressure multiplier in accordance with the present invention.

DESCRIPTION OF THE PREFERRED EMBODIMENTS

An injector in accordance with the present invention has a 3/2-way control valve 3. The control valve 3 is arranged inside an injector housing 2. A valve body 7 is movably received in an opening 4 in the injector housing 2. A inlet 5 is provided in the housing and connected with a high pressure collecting chamber (common rail). The valve body 7 in the region of the inlet 5 is provided with a constriction 6.

The constriction 6 on the valve body 7 extends over a conical region 10, on which a seat diameter is formed and cooperates with a seat surface 9 provided in the housing. It releases or closes an inlet 12 to a control chamber 13. The control body 7 is surrounded by a valve chamber 8, and the valve chamber opens into a leakage oil opening 11 at the side of the injector housing which faces away from the high pressure collecting chamber 5.

An outer piston 14 of a pressure multiplier is received in an opening in the injection housing 2. It extends with its upper ring-shaped end surface into a control chamber 13 in the injector housing 2, which can be loaded with a control chamber volume through the above mentioned control chamber inlet 12. The outer piston 14 as shown in the drawings is cup-shaped and provided with screw-in element 15. The screw-in element 15 provided with an outer thread 17 can be screwed into the outer piston 14. For this purpose it is provided with a tool projection 16 which can be formed for example as a hexagonal surface. The screw-in surface element 15 which can be screwed into the outer piston 14 has a ring 19 on its lower end surface 18. It serves for centering a spring element 20.

The spring element 20 shown in the drawings is formed as a flat spring. It abuts on the one hand against the lower end surface 18 of the screw-in element 15 and abuts with its outer edge regions against the upper end surface 23 of an inner piston 22. The inner piston 22 abuts with its head region against a ring shaped surface which extends around the lower opening in the outer piston 14. The spring element 20 received by the lower end surface 18 of the screw-in element 15 and the upper end surface 23 of the inner piston 22 produces a pretensioning between the outer piston 14 and the inner piston 22 in an axial direction.

The head region of the inner piston 22 is guided with a radial plate 21 relative to the opening of the outer piston 14. The plate or gap 25 is provided also between the shaft region 24 of the inner piston 22 and the opening in the bottom of the outer piston 14. The outer piston 14 is closed substantially by an upper housing half of the injector housing 22. The shaft 24 of the inner housing 22 substantially extends into a lower housing half of the injector housing 22. The both housing halves of the injector housing 22 abut against one another along a separation joint 26.

The outer piston 14 abuts at the housing side against a spring element 27 which can be formed for example as a spiral spring. In the illustration of FIG. 1 it is compressed approximately to a blocking length. The spiral spring is supported against a bottom surface 37 provided in the injector housing 2. A branch 29 extends from the hollow chamber in which the spiral-shaped spring element 27 is supported. It opens into an opening 28 in the lower housing half of the injector housing 22. A ventilation valve 30 is loaded through it. It fills a pressure chamber 34 with a fuel under high pressure with interposition of a throttle element.

The ventilating valve 30 includes substantially a sealing element which is as a spherical body 31 and is pretensioned via a spring element 33. With the spring element the opening pressure of the sealing body 31 in the ventilation valve 30 can be fixed. With the constant loading of the pressure chamber 34 with fuel under high pressure via the ventilation valve 30 and supply opening 28, it is guaranteed that a sufficient fuel value is provided in the pressure chamber 34 at all times. With pressure loading of the control chamber 13 through the outer piston 14 which moves downwardly and the positive guidance of the inner piston 22, a compression by the lower end surface 35 of the inner piston 22 which moves in the pressure chamber 34. Because of the adjusting pressure increase in the pressure chamber 34, a fuel volume flows through the nozzle inlet 36 in direction toward the injection nozzle.

An axial pretensioning of the outer piston 14 and the inner piston 22 relative to one another can be obtained with the spring element 30 which in the embodiment shown in the drawings is shown as a plate spring. The spring element 20 is adjustable by the screw-in element 15 or its screw-in depth with an outer thread 17 in the outer piston 14. Also, the spring force can be adjusted by the arrangement of several plate springs, whether in the same direction-or in the opposite direction, between the lower end surface 18 of the screw-in element 15 and the upper end surface 23 of the inner piston 22. The solution shown in the drawings is characterized first of all in that, the housing tolerances or the pressure multiplier tolerances can be selected in a substantially cost-favorable manner, since with the radial play or gap 21 and 25 provided in the head region of the inner piston or its shaft 24 relative to the outer piston 14, housing tolerances of a preferably two-part housing can be compensated. The tolerances of the outer piston 14 as well as the inner piston 22 can be selected favorably for the manufacturing process, when the injector housing 2 is formed as two-part housing, whose surfaces abut against one another on the separation joint 26.

In addition to controlling the control chamber volume of the control chamber 13 via the 3/2-way valve 3 in its inlet 12, the piston arrangement 14, 22 or in other words the pressure multiplier also allows to control through the lower chamber in which in the shown embodiment the spring element 27 is received. This can be performed when at the secondary side of the pressure multiplier, or in other words at the end surface 35 of the inner piston 22, also a control pressure is provided.

It will be understood that each of the elements described above, or two or more together, may also find a useful application in other types of constructions differing from the types described above.

While the invention has been illustrated and described as embodied in injector with subdivided pressure multiplier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An injector for injection a fuel under high pressure into a combustion chamber of an internal combustion engine, the injector comprising an injector housing; a control chamber; a primary-side inlet to said control chamber a control valve which controls said primary-side inlet to said control chamber, a pressure multiplier movable in said injector housing, said pressure multiplier being formed as a two-part piston arrangement, said piston arrangement having an outer piston and an inner piston inserted in said outer piston, said outer piston and said inner piston being axially pretensioned relative to one another; and means for axially pretensioning said outer piston and said inner piston relative to one another.

2. An injector as defined in claim 1, wherein said means for axially pretensioning include a spring element which is provided between a lower end surface of a screw-in element and an end side of said inner piston.

3. An injector as defined in claim 1, wherein said means for axial pre-tensioning include a screw-in element providing the pre-tensioning between said outer piston and said inner piston.

4. An injector as defined in claim 1, wherein said inner piston is guided in said outer piston with a radial play.

5. An injector as defined in claim 1, wherein said housing has two halves, said outer piston being arranged in one of said halves of said housing, while said inner piston has a shaft and is arranged with said shaft in another half of said housing.

6. An injector as defined in claim 1, wherein said pistons of said piston arrangement are radially oriented relative to one another in said injector housing which is separated along a separation joint.

7. An injector as defined in claim 1; and further comprising a spring element which is supported in said injector housing and pretensions said outer piston against said control chamber.

* * * * *